United States Patent [19]

Fujiwara

[11] Patent Number: 5,052,173

[45] Date of Patent: Oct. 1, 1991

[54] METHOD OF OPERATING A SPINNING APPARATUS AND A YARN SPLICING DEVICE

[75] Inventor: Michiaki Fujiwara, Kameoka, Japan

[73] Assignee: Murata Kikai Kabushiki Kaisha, Kyoto, Japan

[21] Appl. No.: 492,770

[22] Filed: Mar. 13, 1990

Related U.S. Application Data

[62] Division of Ser. No. 221,674, Jul. 20, 1988, Pat. No. 4,939,893.

[30] Foreign Application Priority Data

Jul. 21, 1987 [JP] Japan ..... 62-181934

[51] Int. Cl.[5] ..... D01H 1/115; D01H 15/00

[52] U.S. Cl. ..... 57/22; 57/261; 57/328

[58] Field of Search ..... 57/22, 261, 263, 328, 57/333

[56] References Cited

U.S. PATENT DOCUMENTS

| | | | |
|---|---|---|---|
| Re. 32,372 | 3/1987 | Rohner | 57/22 |
| 4,419,861 | 12/1983 | Fujiwara et al. | 57/261 |
| 4,433,534 | 2/1984 | Mima | 57/261 X |
| 4,445,317 | 5/1984 | Mima | 57/22 |
| 4,456,188 | 6/1984 | Sakai et al. | 57/261 X |
| 4,485,616 | 12/1984 | Morita et al. | 57/261 |
| 4,487,012 | 12/1984 | Horiuchi et al. | 57/261 |
| 4,498,283 | 2/1985 | Kodama et al. | 57/261 |
| 4,535,944 | 8/1985 | Nakahara et al. | 57/261 X |
| 4,565,059 | 1/1986 | Mima | 57/22 |
| 4,653,258 | 3/1987 | Rohner | 57/22 |

*Primary Examiner*—Joseph J. Hail, III

*Attorney, Agent, or Firm*—Spensley Horn Jubas & Lubitz

[57] ABSTRACT

In a spinning device or a yarn splicing device, respective ends of first and second yarn portions are transferred toward respective first and second untwisting devices. An untwisting operation of the second untwisting device is started and continues for a first time period. An untwisting operation of the first untwisting device is started at the lapse of the first time period.

8 Claims, 9 Drawing Sheets

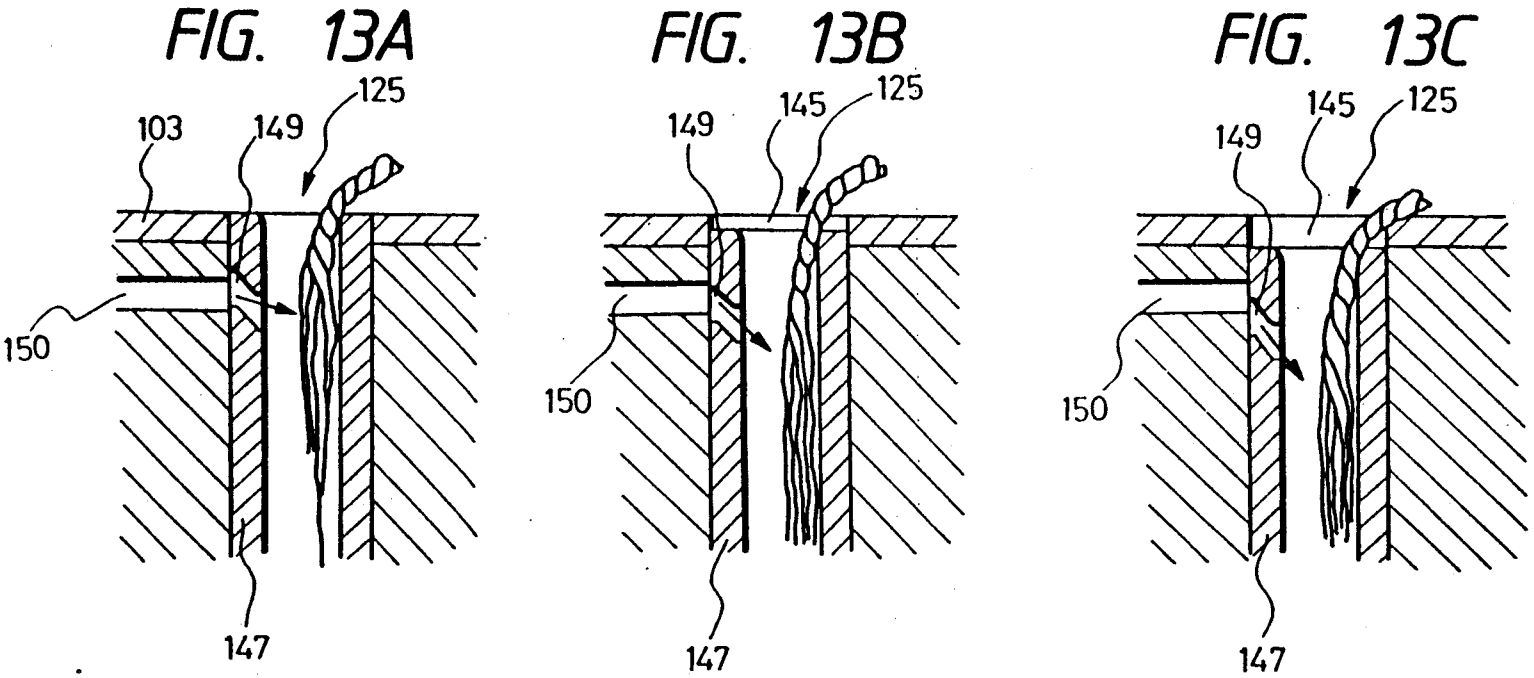
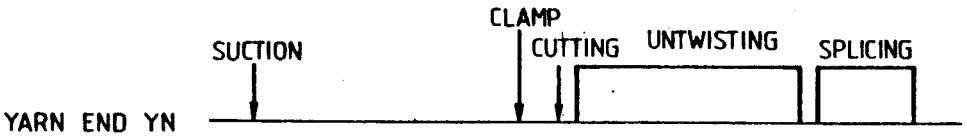
FIG. 18A
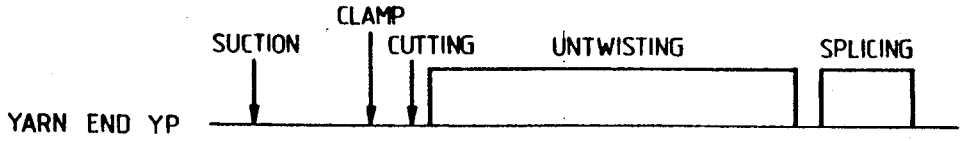
FIG. 18B

METHOD OF OPERATING A SPINNING APPARATUS AND A YARN SPLICING DEVICE

This is a division of application Ser. No. 07/221,674 filed on July 20, 1988 now U.S. Pat. No. 4,939,893.

FIELD OF THE INVENTION AND RELATED ART STATEMENT

This invention relates to a spinning apparatus of the type wherein a large number of spinning units are provided in a juxtaposed relationship.

A so-called pneumatic spinning machine is already known wherein slivers are successively supplied to and drafted by a drafting device and then supplied to an air jetting nozzle which produces whirling air flows so as to produce a spun yarn by an action of the whirling air flows whereafter the yarn thus spun out is wound by means of a winding device.

Such a pneumatic spinning machine normally includes a large number of spinning units disposed in a horizontally juxtaposed relationship and each composed of such a drafting device, an air jetting nozzle and a winding device as described above, and an apparatus is also known wherein a yarn knotting bogie for effecting yarn knotting for such a large number of winding units travels along the winding units.

By the way, in such a pneumatic spinning machine as described above, each drafting device has a high draft ratio exceeding 200 times, and if slivers are supplied directly to the drafting device and then passed through the drafting device and the air jetting nozzle, then a spun yarn is obtained immediately. Accordingly, a package which is wound on the winding device may have an arbitrarily great diameter as distinct from a spinning bobbin produced on a ring spinning machine.

In particular, if it is intended to produce a package (normally wound up into a cone, cheese or the like having a diameter greater than 10 cm so that it may be suited for a weaving step as a step after spinning) of a desired great diameter using a ring spinning machine, it is necessary to rewind a spinning bobbin wound up on the ring spinning machice by means of a winder (rewinding machine) which is a different machine and to splice yarns on several tens spinning bobbins to each other to make a single package. To the contrary, with the pneumatic spinning machine, yarn splicing for obtaining a yarn of a desired full length in such a manner as described above is unnecessary. If this is examined for a package thus obtained, a single package essentially has several tens yarn joints therein where it is produced on a ring spinning machine, but where it is produced on a pneumatic spinning machine, theoretically it has no yarn joint therein.

In fact, however, even in a pneumatic spinning machine, a yarn may break naturally or may be compulsorily cut to remove a yarn defect detected by a detector before a single package is fully wound up. Thereupon, a yarn knotting bogie which travels along the winding units effects yarn splicing. Accordingly, an average of 2 or 3 yarn joints produced by the yarn knotting bogie are contained in a single package produced on the pneumatic spinning apparatus. However, if a following spinning step is taken into consideration, it is preferable to further reduce the reduced number of such yarn joints or to form a yarn joint such that it may have a substantially same condition with any other portion of the yarn than the joint.

OBJECT AND SUMMARY OF THE INVENTION

It is an object of the present invention to provide a spinning apparatus on which a good package can be produced wherein a yarn joint on the wound up package after it has been spun out from an air jetting nozzle is every similar in its condition to any other portion of the yarn than the yarn joint.

According to the present invention, a spinning apparatus of the type which includes a large number of spinning units provided in a juxtaposed relationship, and a yarn splicing bogie for traveling along the spinning units to effect a yarn splicing operation for the spinning units, is constituted such that each of the spinning units includes a drafting device, an air jetting nozzle for applying a twist to a fiber bundle drafted at the drafting device, and a winding device for winding a yarn spun out from the air jetting nozzle, and a yarn splicing device on the yarn splicing bogie is formed as a pneumatic yarn splicing device.

BRIEF DESCRIPTION OF THE DRAWINGS

FIGS. 13A, 13B and 13C are enlarged sectional views of a control nozzle.

DETAILED DESCRIPTION OF PREFERRED EMBODIMENTS

Figure 1:
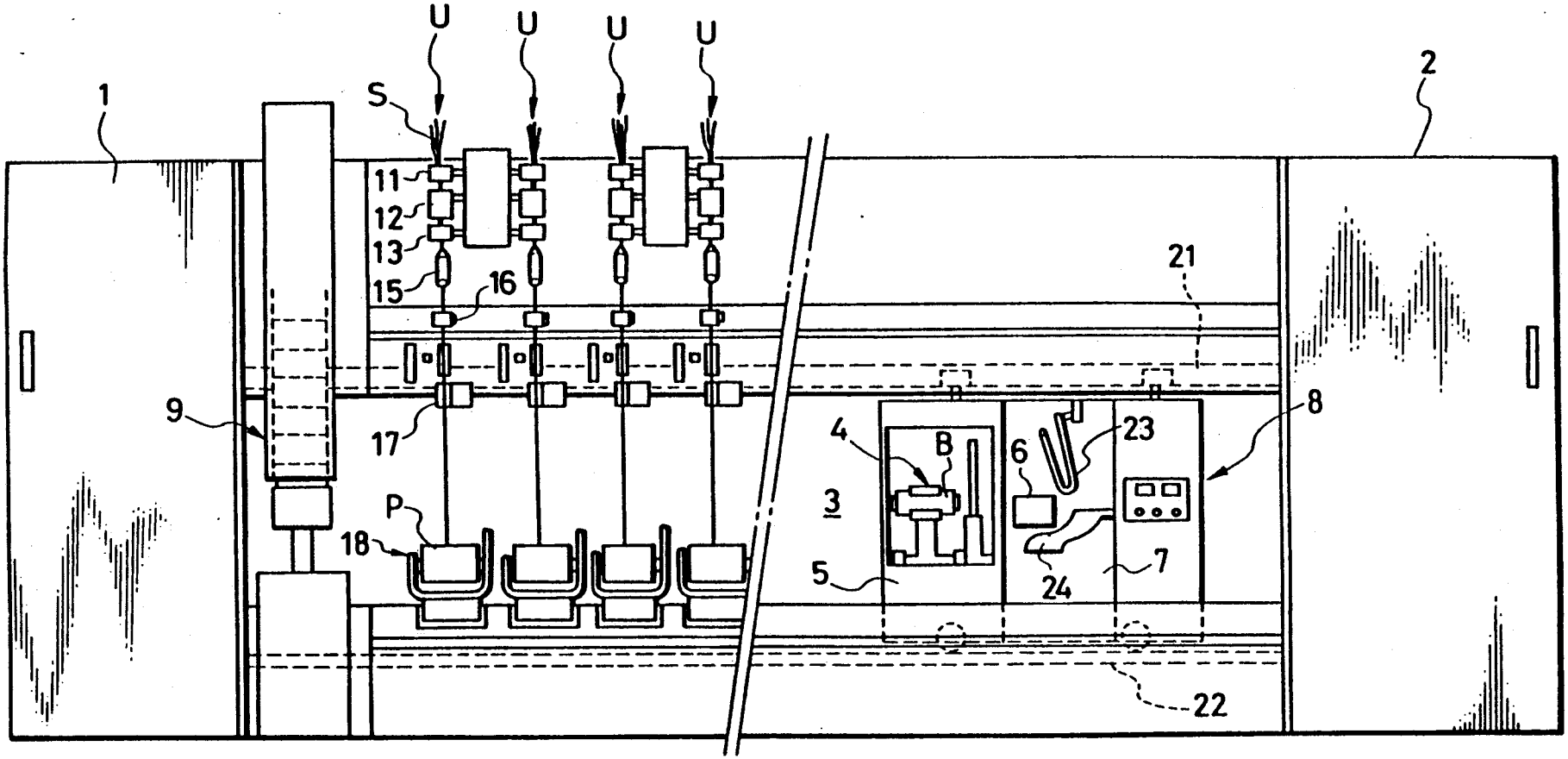
FIG. 1 is a front elevational view of a spinning apparatus according to the present invention, FIG. 2 a vertical sectional side elevational view of the same, FIG. 3 an explanatory view of a sucking duct portion, FIG. 4 a vertical sectional view of a valve device and a connecting device portion, FIG. 5 a front elevational view of a yarn splicing device, FIG. 6 a front elevational view, partly omitted, of the yarn splicing device.

FIG. 1 shows a front elevational view of a pneumatic spinning machine according to the present invention, and the present spinning machine includes a large number of spinning units U provided in a juxtaposed relationship in a row between a prime mover box 1 and a blower box 2. A bogie traveling spacing 3 is provided along the row of the units U in a longitudinal direction of a machine frame of the spinning machine, and a traveling bogie 8 travels in the spacing 3. The traveling bogie 8 is composed of a doffing bogie 5 equipped with a doffing device 4 and a yarn splicing bogie 7 integrated with the doffing bogie 5 and equipped with a pneumatic yarn splicing device 6 which will be hereinafter described in detail. Reference numeral 9 denotes a take-up tube supply device located between the prime mover box 1 and the spinning units U for supplying take-up tubes to the doffing device 4.

Figure 2:
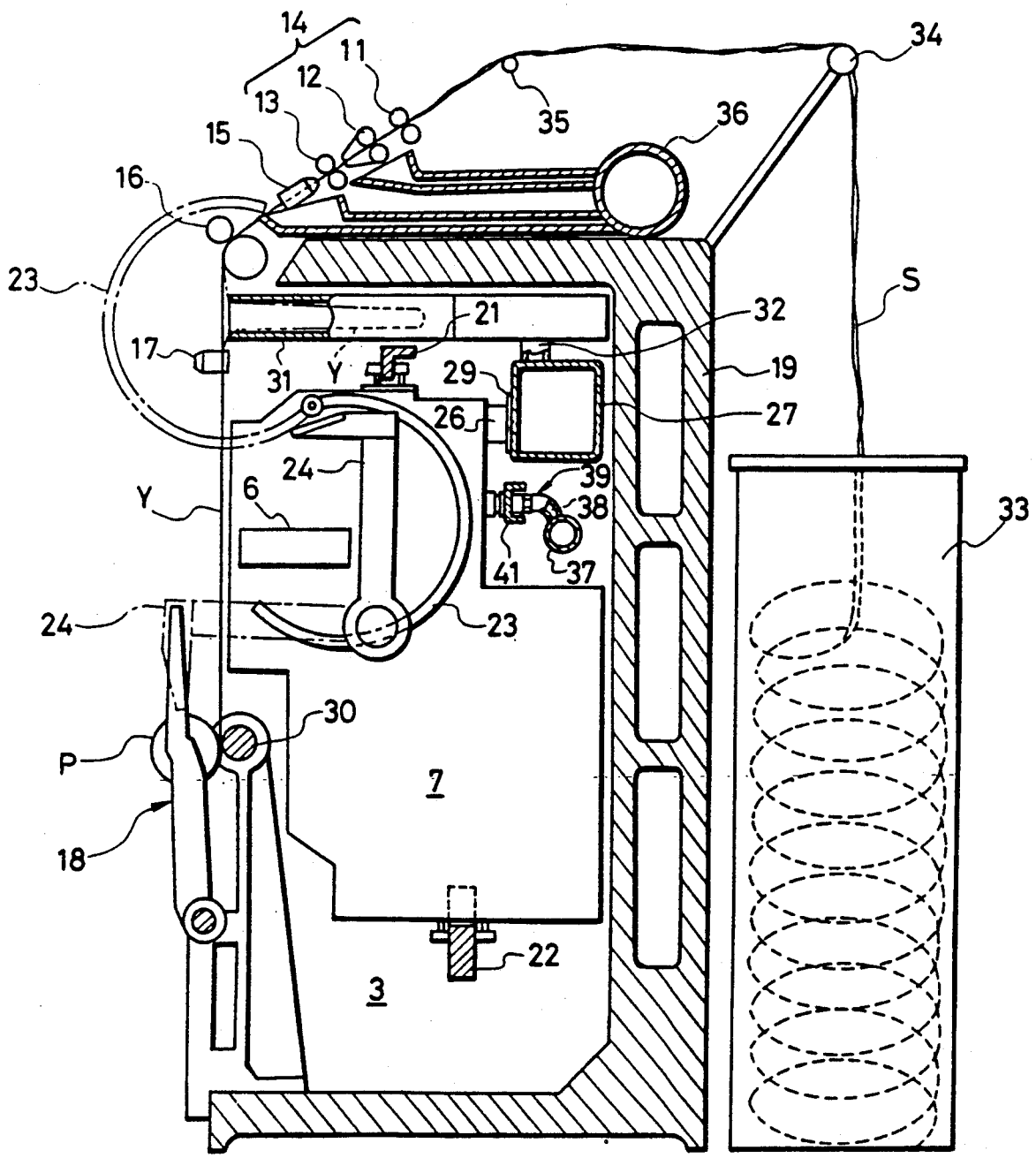

FIG. 2 is a schematic side elevational view in vertical section of the present spinning machine together with the yarn splicing bogie 7, and each of the spinning units U is composed of a drafting device 14 consisting of back rollers 11, middle rollers 12 and front rollers 13, an air jetting nozzle 15, a nip roller 16 for drawing out a spun yarn Y produced by the nozzle 15, a slub catcher 17 for detecting a thick yarn portion of the spun yarn, and a winding device 18 for winding the yarn Y onto a package P while traversing. It is to be noted that two air jetting holes having opposite whirling directions relative to each other are provided in the nozzle 15.

The spinning units U are disposed on a frame member 19 having a channel-shaped side section, and the yarn splicing bogie 7, that is, the traveling bogie 8 travels in the leftward and rightward directions in FIG. 1 along a pair of rails 21 and 22 within the bogie traveling spacing 3 surrounded by the frame member 19.

Figure 3:
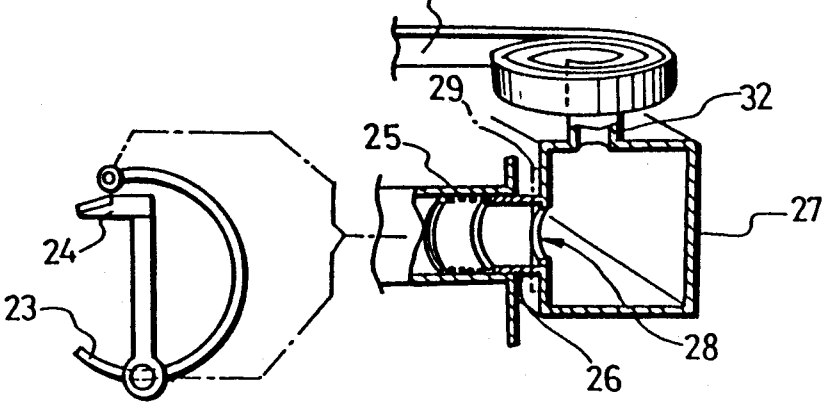

Provided for individual pivotal motion as shown in long and short dash lines in FIG. 2 on the yarn splicing bogie 7 are a suction pipe 23 for sucking and holding an upper yarn YN on the spin out side (on the nozzle 15 side) and introducing the same to the pneumatic yarn splicing device 6, and a suction mouth 24 for sucking and holding a lower yarn YP on the package P side and introducing the same to the pneumatic yarn splicing device 6, and such a connecting duct 26 which is normally urged to project outwardly of the bogie 8 by a spring 25 as shown in FIG. 3 is provided in a contiguous relationship on each of the base end sides of the suction pipe 23 and the suction mouth 24. The duct 26 is contacted with a suction duct 27 which extends along the units U in the spacing 3 so that sucking from the suction pipe 23 and the suction mouth 24 may be effected.

In particular, openings 28 are formed at suitable locations of the suction duct 27 in a spaced relationship by a distance equal to the distance between the adjacent units U, and a butterfly valve 29 in the form a plate mounted for opening and closing motion like a shutter and normally urged in the closing direction by a spring not shown is provided for each of the openings 28 such that, as the bogie 7 moves, the connecting duct 26 may successively kick the butterfly valves 29 to communicate the openings 28 with the connecting duct 26.

Reference numeral 31 denotes a slack tube formed from an elongated tubular pipe having one end opened to a yarn path between the nip roller 16 and the slub catcher 17, and the base end side of the slack tube 31 is formed like a whirlpool in order that the effective length thereof over which it can suck a yarn therein may be increased (FIGS. 2 and 3).

The slack tube 31 has a base end 32 connected and opened to the suction duct 27.

Meanwhile, reference numeral 30 denotes a friction roller which contacts with and rotates the package P.

Slivers S to be supplied to the drafting device 14 in FIG. 2 are drawn out from a sliver can 33 provided at a rear location of the machine frame and are supplied via guide rollers 34 and 35 to the back rollers 11. Reference numeral 36 denotes a discharging pipe installed over the entire spinning units U for sucking and discharging fly waste and waste yarns produced on the drafting devices 14, air jetting nozzles 15 and so on, and 37 a compressed air pipe installed similarly over the entire spinning units U for supplying compressed air for operation of the pneumatic yarn splicing devices 6 which will be hereinafter described, and the compressed air pipe 37 has branch pipes 38 provided projectingly thereon in a spaced relationship by a distance equal to the distance between the adjacent units U while a valve device 39 is provided at an end of each of the branch pipes 38 for connecting the branch pipe 38 to the yarn splicing bogie 7. Reference numeral 41 denotes a support frame member extending along the row of the units U and supporting the valve devices 39 thereon.

Figure 4:
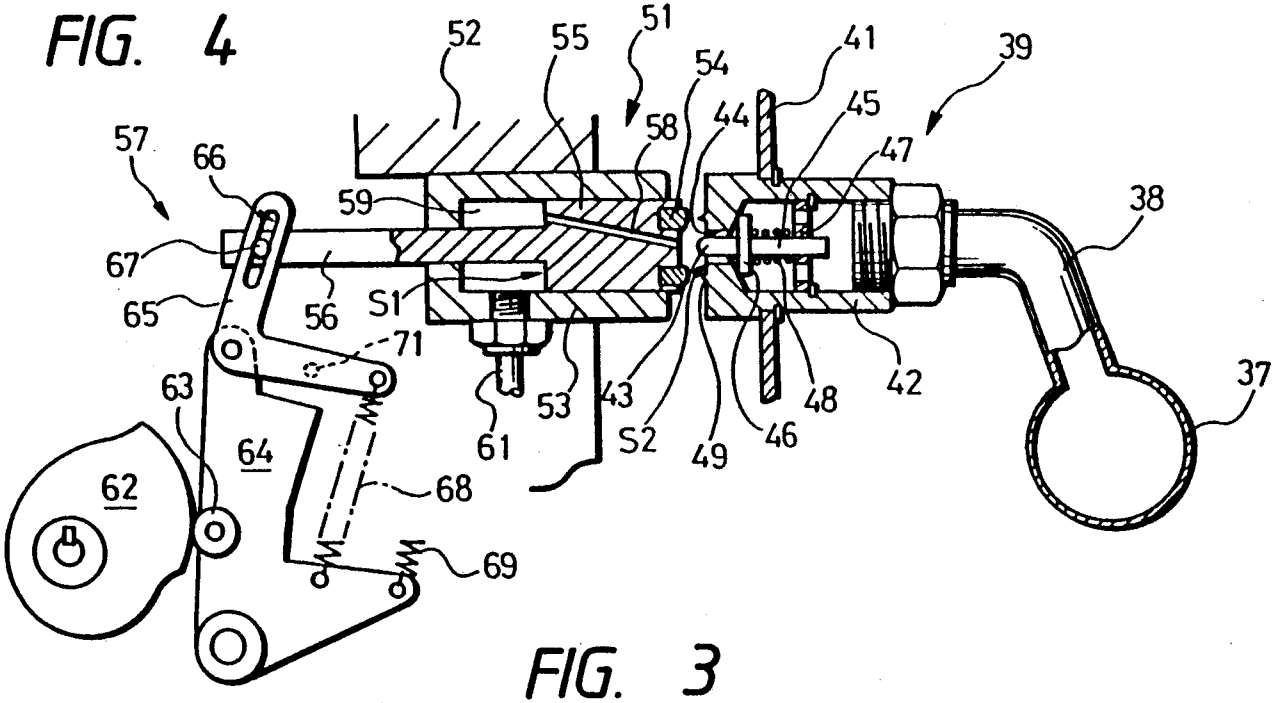

Each of the valve devices 39 is composed, as shown in FIG. 4, of a housing 42 supported on the support frame member 41, and a valve spool member 45 supported for back and forth movement in the housing 42 and having an end portion 43 extending through an opening 44 toward the bogie 7, and a valve portion 46 in the form of a flange is formed at an intermediate location of the valve spool member 45 and normally urged in its closing direction by a spring 48 interposed between the valve portion 46 and an annular support member 47 on which a base end of the valve spool member 45 is supported for sliding movement. Reference numeral 49 denotes an annular rib for preventing leakage of air.

Further, on the yarn splicing bogie 7 side, such a connecting device 51 as described below is provided for acting to push on the valve device 39 to open the valve portion 46 to communicate compressed air into the bogie 7.

In particular, the connecting device 51 is composed, as shown in FIG. 4, of a piston housing 53 supported on a bogie frame 52, a piston member 55 supported for back and forth movement in the housing 53 and having a rubber ring 54 provided at an end portion thereof for contacting with the rib 49, and a back and forth driving device 57 connected to a rod portion 56 of the piston member 55, and if the piston member 55 is projected out by the back and forth driving device 57 and contacted with the valve device 39, then the valve portion 46 is opened so that compressed air is admitted into a hollow portion 59 behind the piston member 55 by way of a communicating hole 58 perforated in the piston member 55 and is then introduced into the pneumatic yarn splicing device 6 which will be hereinafter described by way of a pipe 61 connected to the hollow portion 59. It is to be noted that the area S1 over which the pressure within the hollow portion 59 applies a force rightwardly in FIG. 4 is set greater than the area S2 within the annular rib 49 so that if compressed air is introduced into the hollow portion 59, the piston member 55 is automatically held in its contacting condition. The back and forth driving device 57 is composed of a rocking lever plate 64 for engaging with a rotary cam plate 62 by way of a cam roller 63, and an L-shaped lever 65 provided at a rocking end of the lever plate 64, and the rod portion 56 of the piston member 55 is connected to the L-shaped lever 65 by a pin 67 fitted in an elongated hole 66 in the L-shaped lever 65.

Reference numeral 68 denotes a tension spring for normally urging the L-shaped lever 65 in the clockwise direction in FIG. 4, 69 a tension spring for urging the rocking lever plate 64 in the counterclockwise direction in FIG. 4, and 71 a stopper pin.

Figure 5:
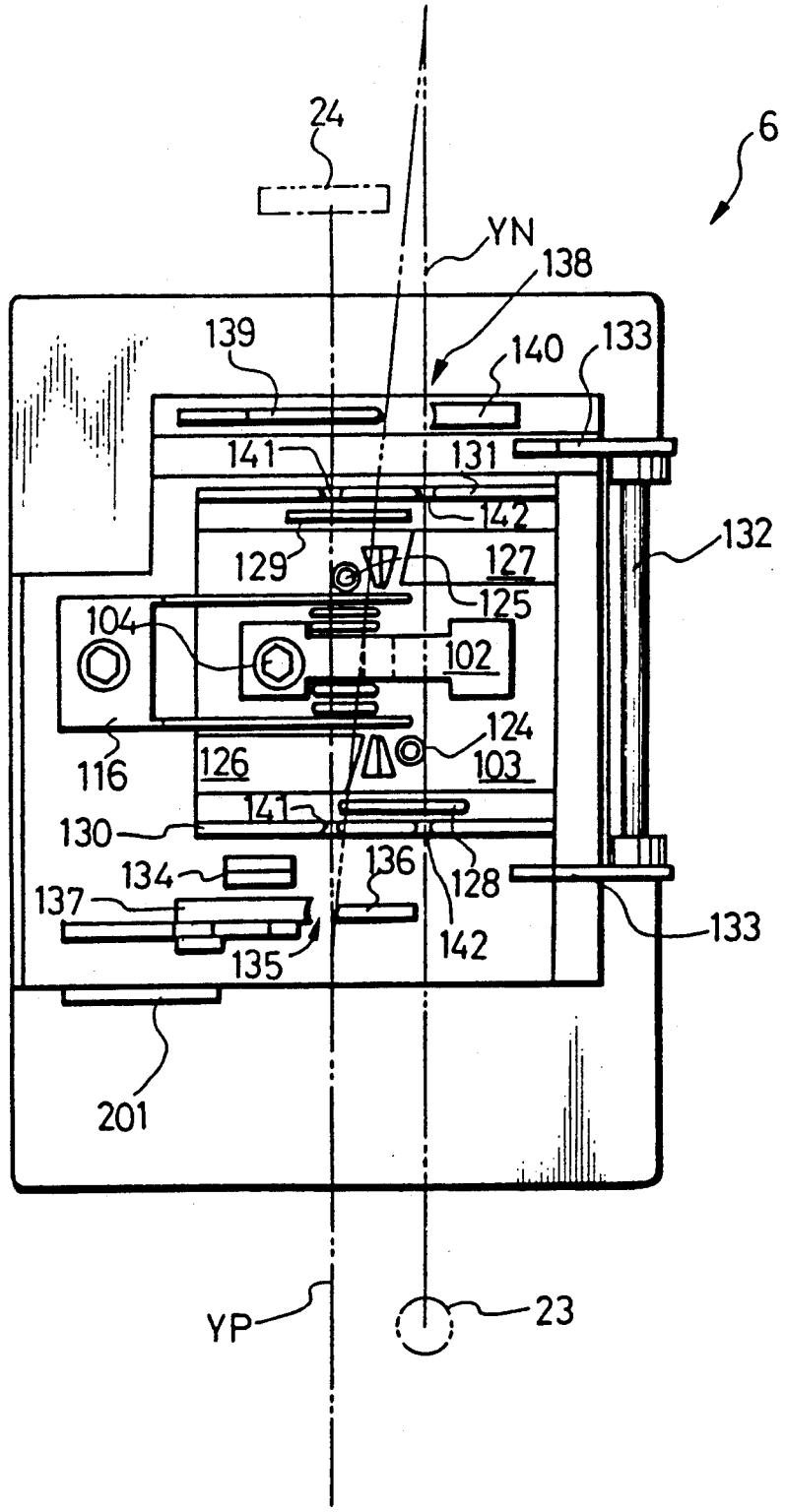

Subsequently, the pneumatic yarn splicing device 6 carried on the yarn splicing bogie 7 will be described in detail with reference to FIG. 5 and several figures following the same.

In particular, at a substantially central location of the yarn splicing device 6, a yarn splicing device 102 is secured to a bracket 103 by a screw 104, and a cylindrical yarn splicing hole 105 is perforated at the center of the yarn splicing member 102. A slit 106 suitable for insertion of a yarn Y from outside is formed in the yarn splicing hole 105 over the entire length of the yarn splicing hole 105 in the tangential direction, and a jetting nozzle 107 which is tangentially opened to the yarn splicing hole 105 is perforated in the yarn splicing member 102. Further, a pair of control plates 112 and 113 are secured to side walls 108 and 109 on the opposite opening sides of the yarn splicing hole 105 of the yarn splicing member 102 with spacers 110 and 111 interposed therebetween, respectively, and side edges 114 and 115 of the control plates 112 and 113 are positioned at positions at which they extend across part of the opposite opening portions of the yarn splicing hole 105.

The control plates 112 and 113 have an action to cooperate with a pair of yarn holding levers 116 which will be hereinafter described to position two yarn ends including a yarn end YP on the package side and another yarn end YN on the air jetting nozzle 15 side which are to be inserted into the yarn splicing hole 105 so that they may be positioned at positions wherein first entangling of the two yarn ends YP and YN is assured when air is jetted from the jetting nozzle 107 and to control the amount of air to be flowed out from the pair of openings at the opposite ends of the yarn splicing hole 105 to prevent leaping out of the yarn ends YP and YN from the yarn splicing hole 105. The control plates 112 and 113 are provided further to obtain a joint of a fair appearance by means of suitable whirling flows. Meanwhile, the spacers 110 and 111 are provided to prevent the yarn ends YP and YN from leaping out of the slit 106 by an increased amount of compressed fluid which runs against walls of the control plates 112 and 113 and flows out toward the slit 106, and gaps are formed between the wall faces 108 and 109 of the yarn splicing member 102 and the control plates 112 and 113, respectively, to control the amount of fluid to flow out from the slit 106. It is to be noted that supply of fluid to the jetting nozzle hole 107 is supplied from the pipe 61 and a pipe conduit 117 which communicate with the compressed air pipe 37. The aforementioned yarn holding levers 116 are constructed in a pair of upper and lower ones and are supported for pivotal motion on the bracket 103 by means of a support shaft 118.

A pair of yarn guide pins 120 and 121, the pair of yarn holding levers 116, and a pair of yarn guides 126 and 127 as well as a pair of yarn cutting devices 128 and 129 and a pair of fork guides 130 and 131 are disposed in this order on the opposite sides of the openings of the yarn splicing hole 105 of the yarn splicing member 102 near the control plates 112 and 113 of the yarn splicing member 102, and a pair of yarn handling levers 133 and 133 which are secured to upper and lower portions of a support shaft 132 are disposed at a location sidewardly of the yarn splicing member 102. Reference numeral 134 denotes a stopper for the yarn handling levers 133. Reference numeral 135 denotes a clamp device for the package side yarn end YP, and the clamp device 135 is composed of a fixed lever 136 and a movable stopper 137. Reference numeral 138 denotes a clamp device for the air jetting nozzle side yarn end YN, and the clamp device 138 is composed of a pivotal lever 139 and a stopper 140.

Figure 7:
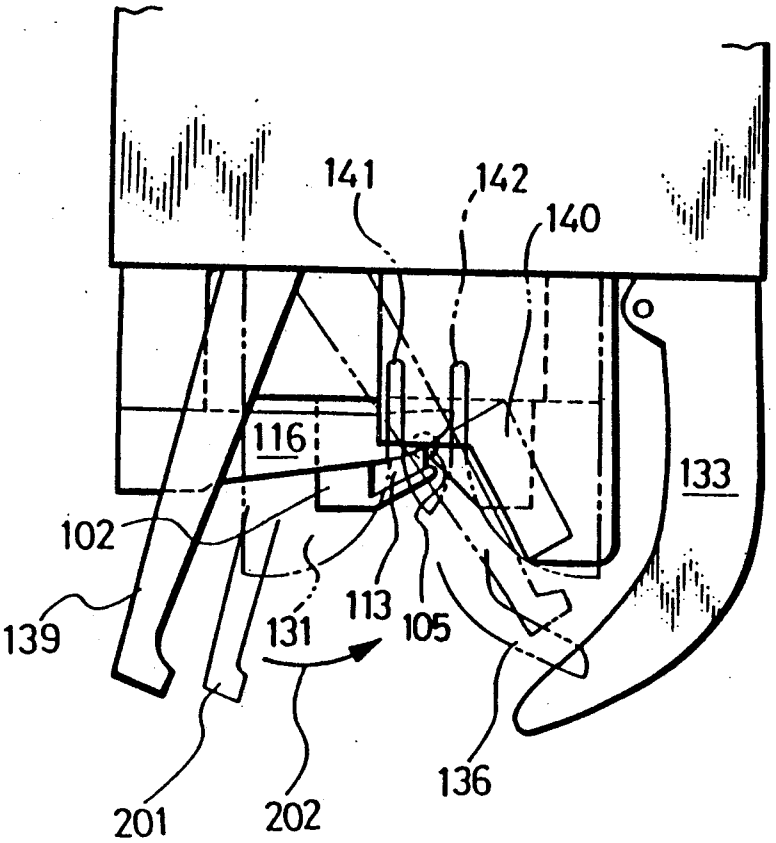
Figure 9:
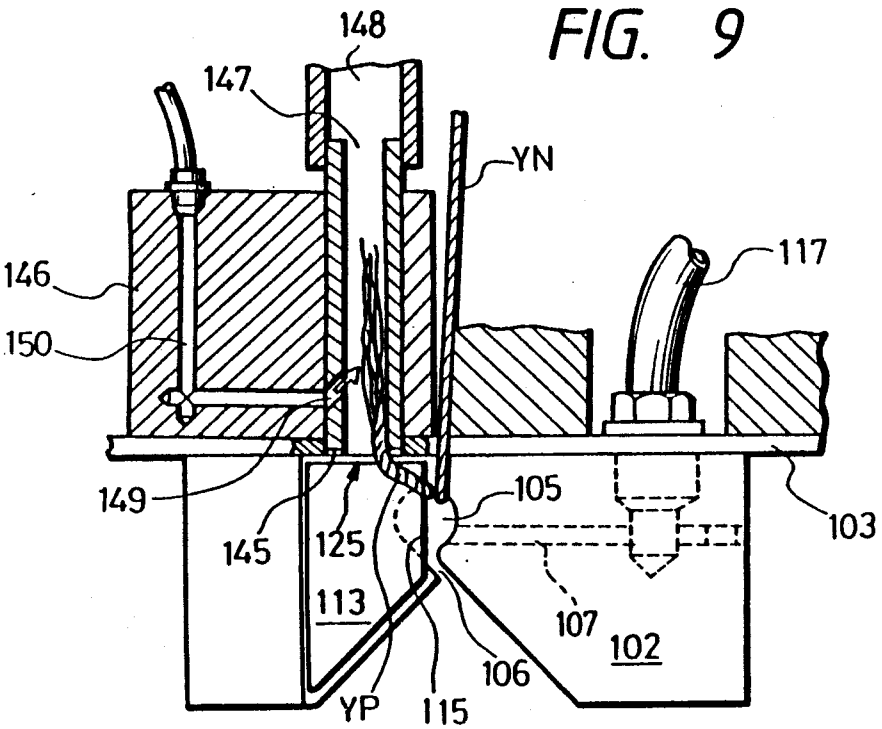
Figure 11:
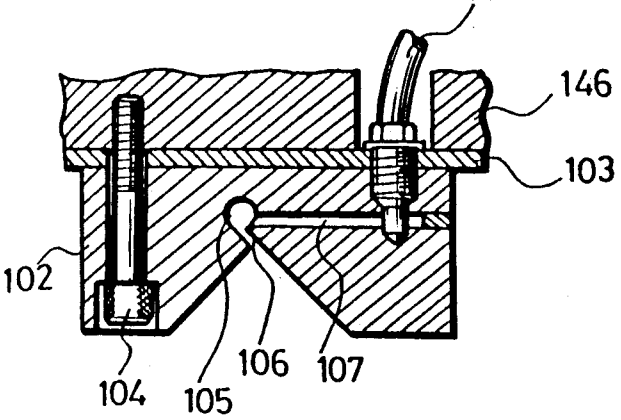
Figure 12:
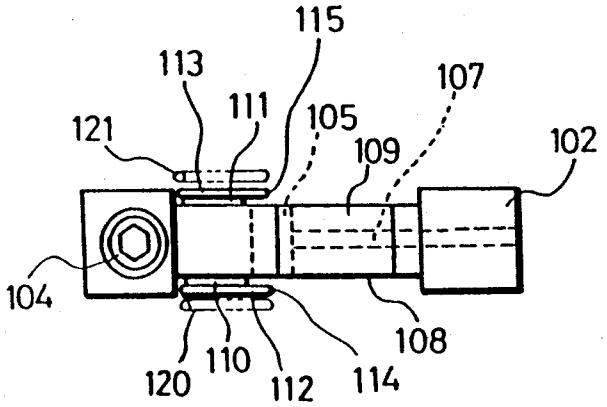
FIG. 12 is a front elevational view of the same.
Figure 10:
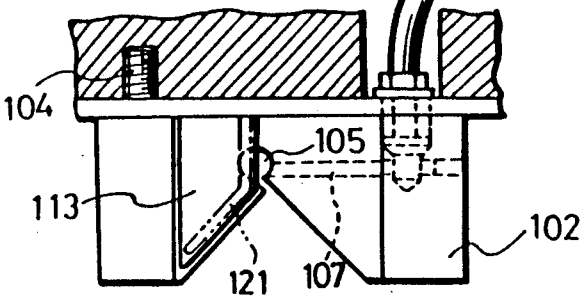
Figure 16:
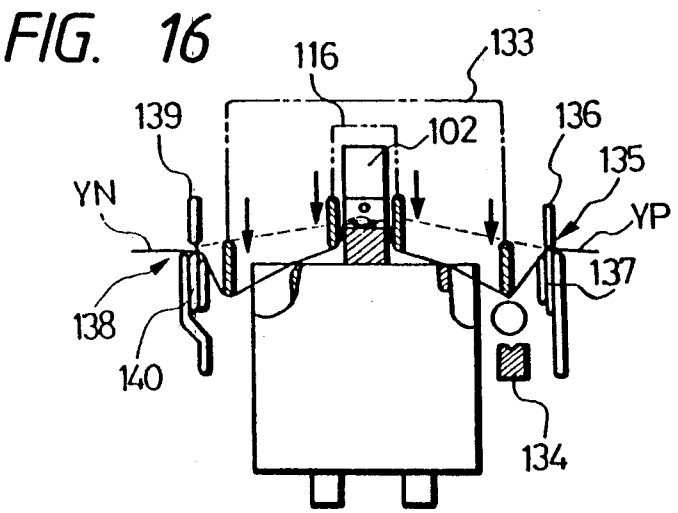
FIGS. 14 to 16 are explanatory views of operation of the apparatus illustrating yarn splicing steps.

The fixed lever 136 is bent at an end thereof in such a manner as shown in FIG. 7 so as to guide the yarn end YP on the package side, and when a pivotal lever 201 at an opposing position is pivoted (arrow mark 202), the yarn end YP guided by the fixed lever 136 is moved to a position between the fixed lever 136 and the movable stopper 137.

Since a pair of control nozzles 124 and 125 have a same shape, the one control nozzle 125 will be described subsequently. Reference numeral 145 denotes a nozzle hole perforated in the bracket 103 and a block 146 integral with the bracket 103, and a sleeve 147 in the form of a pipe is fitted in each of the nozzle holes 145 for sliding movement in the axial direction of the nozzle hole 145. The sleeve 147 is connected to a flexible pipe 148 which connects to a suction pipe not shown. Near an open end of the sleeve 147 in the form of a pipe, a jetting hole 149 directed toward the interior of the sleeve 147 is provided obliquely. The jetting hole 149 communicates with a pressure pipe conduit not shown via an air introducing hole 150 provided in the block 146.

Accordingly, the yarn splicing device 6 operates in the following manner to effect yarn splicing.

In particular, if the slub catcher 17 detects a break of a yarn or detects a defect of a yarn so that the yarn running in the unit U is automatically cut, the yarn splicing bogie 7 is stopped at a time when it arrives at the unit U, and then the package P side suction mouth 24 sucks the yarn end YP from the package P while the air jetting nozzle 15 side suction pipe 23 sucks the spun out yarn end YN directly behind the nozzle 15 whereafter they are both pivoted individually from chain line positions to full line positions in FIG. 2 to introduce the yarn ends YP and Yn into the yarn splicing device 6.

The pair of suction members 23 and 24 are pivoted not in the simultaneous relationship, but the nozzle side yarn end YN is first sucked by the suction pipe 23 and is pivotally moved to and stopped at a position outside the yarn splicing device 6, and then after lapse of a predetermined interval of time, the yarn YP on the package side is sucked into the suction mouth 24 and is pivotally moved to and stopped at a position outside the yarn splicing device 6.

Figure 8:
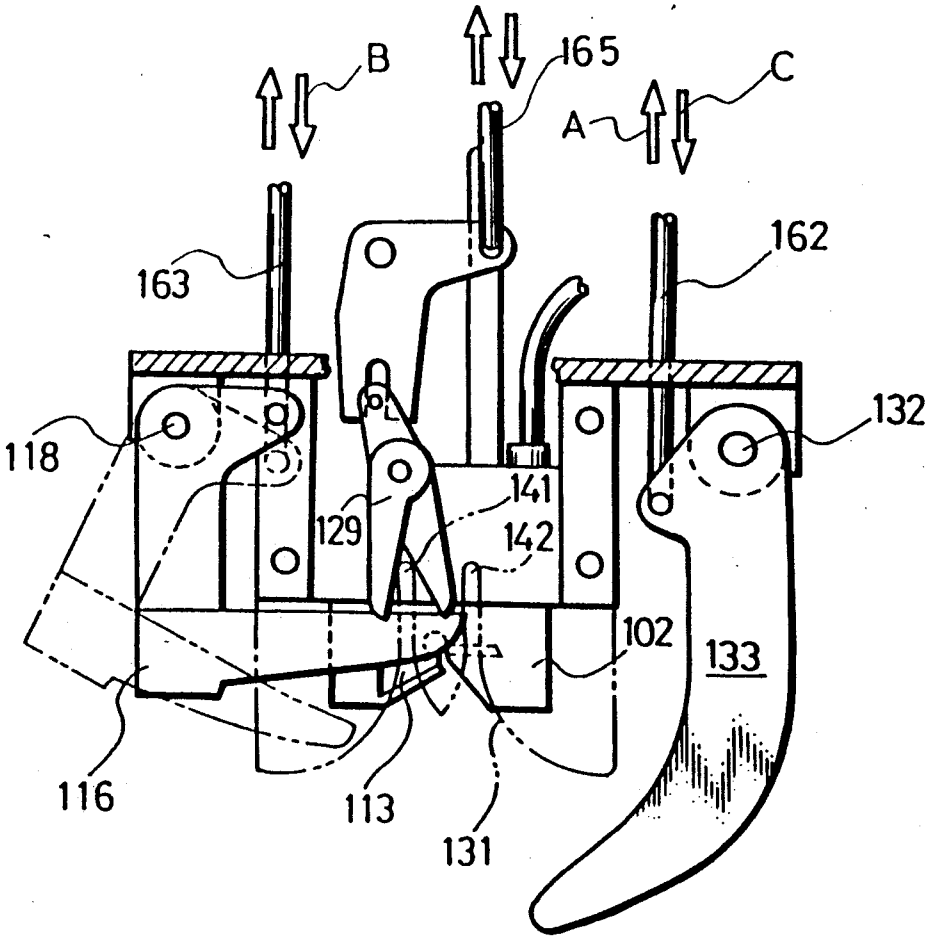
FIGS. 7 and 8 are plan views of the same, FIGS. 9 to 11 plan views of a yarn splicing member.

Within the predetermined interval of time until the package side suction mouth 24 starts its operation after operation of the nozzle side suction pipe 23, the pivotal lever 139 of the yarn clamp device 138 on the nozzle side operates to introduce the yarn YN to a position between the pivotal lever 139 and the stopper 140 while the package side suction mouth 24 sucks the package side yarn YP and pivotally moves the same to and stops at a position outside the yarn splicing device 6 as shown in FIGS. 7 and 8. Thereupon, the yarn YP is introduced to a position between the stopper 137 and the lever 136 of the clamp device 135 by the pivotal lever 201 and immediately clamped by the stopper 137 and the lever 136.

The timings at which the yarn ends YP and YN are clamped by the clamp devices 135 and 138 are displaced such that the timing for the clamp device 138 on the yarn end YN side is later (FIG. 18), and since the yarn end YN is clamped by the clamp device 138, the yarn spun out from the air jetting nozzle 15 is sucked into the slack tube 31 by an accumulated amount thereof, but designing is such that the accumulated amount of the yarn to be sucked into the slack tube 31 may be as short as possible (FIG. 2).

Meanwhile, since it cannot be avoided to effect twisting of the yarn ends YN and YP around each other at the same time at all, such a measure as described above will displace the untwisting times of the yarn ends YN and YP in the control nozzles 124 and 125 such that the untwisting time on the yarn end YN side may be shorter than the untwisting time on the yarn end YP side so that the yarn end YP on the package P side may be untwisted more sufficiently as shown in FIG. 18.

The cutting operation of the clamped yarn ends YN and YP are performed by means of the cutting devices 128 and 129, respectively. As shown in FIG. 8, the starting time for cutting the yarn end YP by the cutting device 129 is determined by a cam means (not shown) which operates a rod 165 connected to the cutting device 129. While, the starting time for cutting the yarn end YN by the cutting device 128 is determined by another cam means in the same manner as in the operation of the cutting device 129. Said cam means is replaceable to another electromagnetic actuater.

After the operations of the package side and nozzle side suction members 23 and 24 are completed, the yarn handling levers 133 and 133 are pivoted around the support shaft 132 so that the yarns YN and YP on both sides are separately introduced into individual guide slots 141 and 142 of the fork guides 130 and 131, respectively, while they are inserted into the yarn splicing hole 105 of the yarn splicing member 102 through the slit 106.

Figure 6:
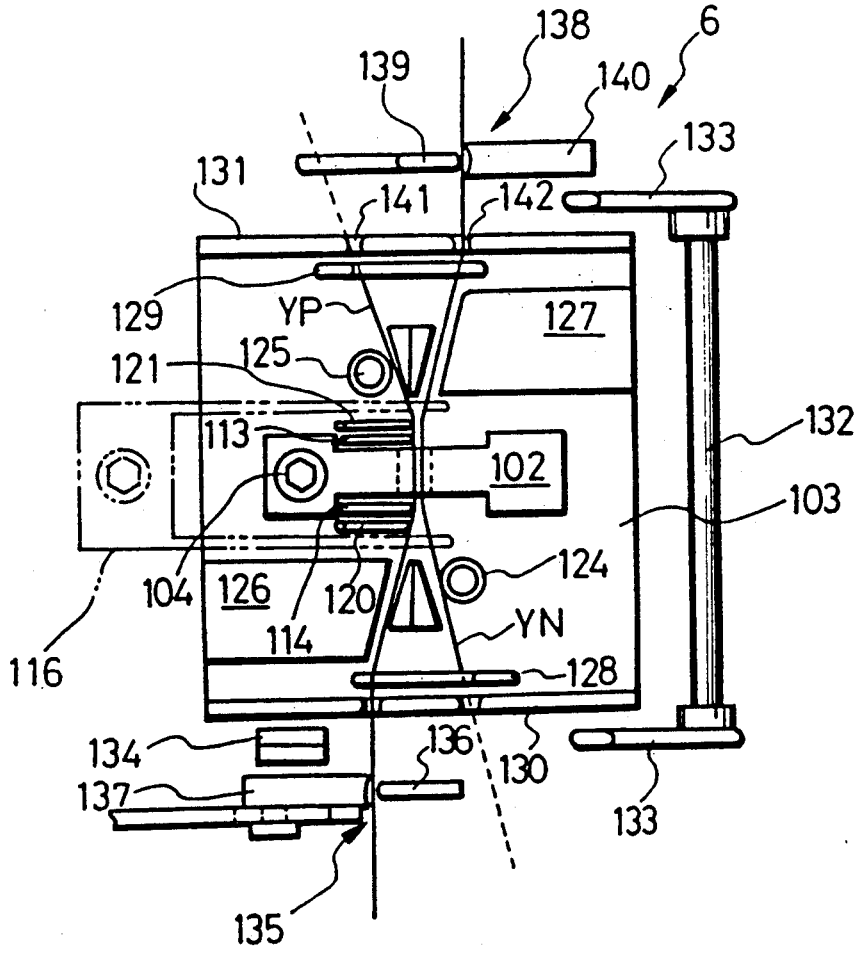

Subsequently, cutting of yarns is effected at locations spaced by a predetermined distance from the package side clamp device 135 and the nozzle side clamp device 138 by the cutting devices 128 and 129, respectively, as shown in FIG. 6. The locations at which the yarns are cut have a relation to the length of a joint thus spliced and have an influence on a feeling of an appearance and the binding strength of a joint thus spliced. The locations at which the yarns are cut are different depending upon the yarn number count of the yarns.

Figure 14:
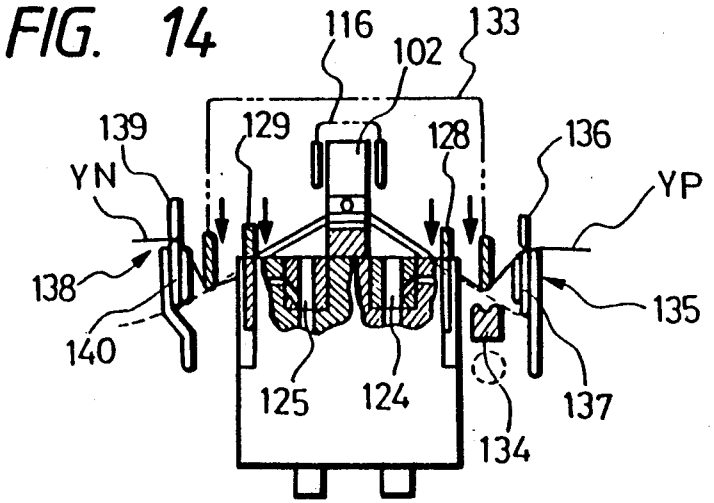

In particular, referring to FIG. 14, the yarns YN and the YP on both sides are clamped by the yarn clamp devices 135 and 138, respectively, and then the yarn pivoting levers 133 operate so that a rod 162 shown in FIG. 8 is moved in the direction of an arrow mark A by a control cam not shown until the pivotal levers 133 are pivoted in the clockwise direction around the support shaft 132, and yarn cutting is effected in this condition. It is to be noted that, when the yarn handling levers 133 and the cutting devices 128 and 129 operate, the yarn holding levers 116 are positioned to a condition pivoted in the clockwise direction around the support shaft 118 by operation (in the direction of an arrow mark B) of a rod 163 as shown in FIG. 8.

Figure 15:
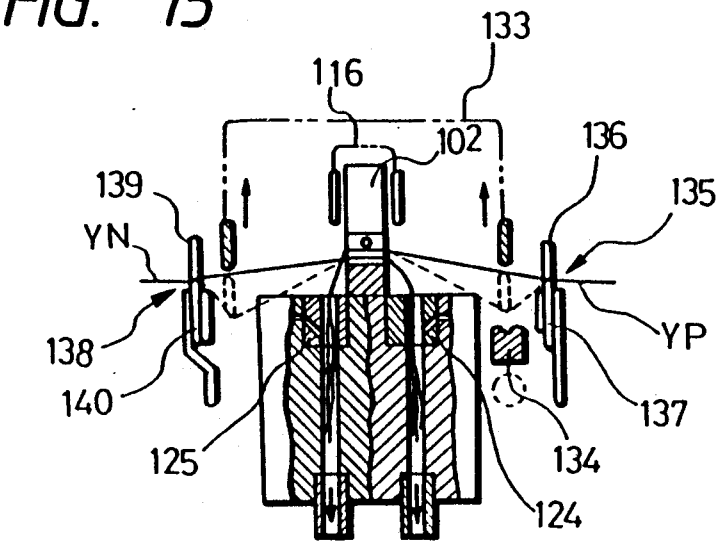

Subsequently, at the same time when or directly before or after the yarn ends YN and YP are sucked by the control nozzles 124 and 125 as shown in FIG. 15, the yarn handling levers 133 are pivoted in the direction to move away from the yarns, that is, in the counterclockwise direction around the support shaft 132 by operation (in the direction of the arrow mark C) of the rod 162 so that they are spaced away from the yarns Y as shown in FIG. 8. Thereupon, the yarn ends YN and YP are sucked into the control nozzle 125 by a sucking action of the sleeve 147 connected thereto via the flexible pipe 147 and then they are untwisted to a condition suitable for yarn splicing by compressed fluid jetted from the jetting hole 149 of the sleeve 147 via the air introducing hole 150.

Here, since the sleeve 147 in which the jetting hole 149 is formed as shown in FIGS. 13A to 13C is fitted for back and forth movement in the nozzle hole 145, the length and the untwisted degree of an untwisted portion of the yarn end are differentiated depending upon the forward or rearward position of the sleeve 147. In particular, where it is assumed that FIG. 13B shows a regular untwisted condition, if the sleeve 147 is fitted at a position a little projected outwardly as shown in FIG. 13A, the jetting hole 149 and the location of the nozzle hole 145 come near to each other so that fluid jetted out from the jetting hole 149 will hit upon comparatively upper portions of the yarn ends YP and Yn, and consequently the length of untwisted portions are increased and the ends becomes thin in an entangled condition. If yarn splicing is effected in this condition, the joint will be ugly and incidental looping readily appears. To the contrary, if the sleeve 147 is pushed in deeply as shown in FIG. 13C, the jetting hole 149 is displaced far from the nozzle hole 145 so that fluid jetted from the jetting hole 149 will hit upon end portions of the yarn ends YP and YN. Accordingly, the length of untwisted portions will be decreased so that the yarn joint after yarn splicing may be weakened or made thinner. Accordingly, the depth of the sleeve is adjusted such that a suitable untwisted condition may be attained depending upon a type of a yarn, a yarn number count and so on.

It is to be noted that the sucking time of the control nozzles 124 and 125 is preferably started directly before yarns are cut by the cutting devices 128 and 129. In particular, since tension is applied to the yarns YN and YP by sucking actions of the nozzle side and package side suction members 23 and 24 when the yarns YN and YP are to be cut, there is the possibility that, as a result of yarn cutting, the yarn ends YN and YP may scatter and move away from the locations of the control nozzles 124 and 125 so that sucking actions of the yarn ends YN and YP by the control nozzles 124 and 125 may not occur. Accordingly, while it is basically possible to cause the control nozzles 124 and 125 to act at the same time as or directly before or after yarn cutting, the control nozzles 124 and 125 are preferably rendered operative directly before yarn cutting as described hereinabove. Meanwhile, supply of fluid to the control nozzles 124 and 125 is effected by changing over of a valve caused by operation of a solenoid not shown.

Further, at the same time when or directly before or after the yarn ends YN and YP are untwisted to a condition suitable for yarn splicing by the control nozzles 124 and 125 and sucking actions of the control nozzles 124 and 125 are stopped, the yarn handling levers 133 operate again so that, while guiding the yarn ends YN and YP with each other, the levers 133 are pivoted to a position in which one of the levers 133 is abutted by the stopper 134 while the yarn holding levers 116 operate to pivot, while similarly guiding the yarn ends YN and YP, to a position in which they contact with faces of the bracket 103. Thus, by one of the yarn handling levers 116, that is, by the lever on the side on which the yarn Y is untwisted by compressed fluid jetted from the jetting nozzle 107 of the yarn splicing member 102, the yarns YN and YP are gripped in such a degree that untwisting thereof is checked. Meanwhile, on the other fork side, since the compressed fluid acts in a direction in which a twist is applied to the yarns YN and YP, they need not particularly gripped and may be sufficiently held only to such a degree that they are controlled in position.

Figure 17:
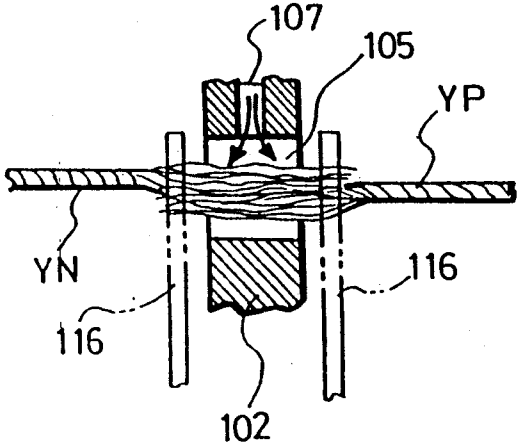
FIG. 17 is an enlarged view of a yarn end illustrating a yarn splicing operation, and FIGS. 18A and 18B a timing chart of individual operations.

The yarn ends YN and YP which have been sucked into the sleeves 147 of the control nozzles 124 and 125 by operation of the yarn handling levers 133 and the yarn holding levers 116 are drawn into the yarn splicing hole 105 of the yarn splicing member 102 until they are set to a condition in which the yarn end portions to be positioned and spliced to each other are placed one on the other, that is, in such a condition as shown in FIG. 17. Thereupon, the length of a yarn joint to be formed by splicing is set by the distances of pivotal motion of the yarn handling levers 133 and the yarn holding lever 116. Accordingly, the distances of pivotal motion of the yarn handling levers 133 and the yarn holding lever 116 are adjusted depending upon a yarn number count.

The yarn ends YN and YP to be drawn out by the sleeves 147 of the control nozzles 124 and 125 by pivotal motion of the yarn handling levers 133 are drawn out while being controlled by the control plates 112 and 113 on both sides of the yarn splicing hole 105 and then positioned on an inner circumferential face of the yarn splicing hole 105 by side edges of the control plates 112 and 113 and side edges of the yarn holding levers 116, and thus set into the yarn splicing hole 105 in a condition in which portions of the yarns to be spliced to be each other are placed one on the other in a contacting condition.

Further, yarn splicing is effected by an action of compressed fluid which is jetted from the jetting nozzle 107 in a condition wherein the yarn ends YN and YP are set in the yarn splicing hole 105. Thereupon, fibers at both of the yarn ends contacted with each other by jetted air from the jetting nozzle 107 are entangled and integrated with one another in advance to whirling, and then they are whirled so that a twist is applied to the thus integrated yarn ends but such whirling and entangling are applied to the opposite side of such twist. Then, since the control nozzles have stopped their sucking actions already, the yarn ends are entangled completely with each other without application of a resistance to end portions of the untwisted yarns and yarn splicing is effected without producing a horn portion.

After completion of the yarn splicing, the yarn handling levers 133 and the yarn holding levers 116 are moved away from the yarns YN and YP, and YN and YP are moved outwardly through the slit 106 of the yarn splicing member 102, whereafter normal spinning operation is resumed.

As described so far, according to the present invention, a good package can be obtained wherein the number of yarn joints in a package wound up with a large diameter is small and besides such yarn joints have a substantially equal thickness and strength to those of any other portion of the yarn.

What is claimed is:

1. A method of operating a spinning apparatus having a jet nozzle device from which yarn exits, a slack reducing device by which slack in the yarn is taken up, a winding device by which yarn is wound to a yarn package, and yarn joining means for joining the end of a first yarn portion extending from the jet nozzle with the end of a second yarn portion extending from the yarn package, the yarn joining means being provided with first and second untwisting means operable for untwisting the ends of the first and second yarn portions, respectively, the method comprising the steps of:

transferring the ends of the first and second yarn portions toward the first and second untwisting means, respectively;

starting the untwisting operation of the second untwisting means;

operating the second untwisting means for a first time period; and starting the untwisting operation of the first untwisting means at the lapse of the first time period.

2. A method as claimed in claim 1, wherein each of the untwisting means comprises a control nozzle and the steps of starting the untwisting operations comprise the steps of sucking the yarn ends into the control nozzles.

3. A method as claimed in claim 1, wherein the yarn joining means has a yarn end splicer, the method further comprising the steps of:

operating the second untwisting means for a second time period following the first time period;

operating the first untwisting means during the second time period;

introducing the yarn ends of the first and second yarn portions to the yarn end splicer following the second time period.

4. A method as claimed in claim 1, further comprising the steps of:

emitting yarn from the jet nozzle;

clamping the first portion with a clamp during the step of starting the untwisting operation of the first untwisting means; and taking up slack in the first yarn portion between the jet nozzle and the clamp with the slack reducer during the step of clamping the first yarn portion.

5. A method as claimed in claim 4, wherein the slack reducer comprises a suction tube, and the step of taking up slack comprises the step of sucking yarn into the suction tube.

6. A method of operating a yarn splicing device by which the yarn end of a first yarn portion is spliced with the yarn end of a second yarn portion, the splicing device provided with first and second untwisting means operable for untwisting the ends of the first and second yarn portions, respectively, the method comprising the steps of:

transferring the ends of the first and second yarn portions toward the first and second untwisting means, respectively;

starting the untwisting operation of the second untwisting means;

operating the second untwisting means for a first time period; and starting the operation of the first untwisting means at the lapse of the first time period.

7. A method as claimed in claim 6, further comprising the steps of:

feeding the first yarn portion toward the yarn splicing device;

clamping the first yarn portion with a clamp following the step of feeding the first yarn portion; and taking up slack in the first yarn portion with a slack reducer during the step of clamping the first yarn portion.

8. A method as claimed in claim 6, wherein the yarn joining device has a yarn end splicer, the method further comprising the steps of:

operating the second untwisting means for a second time period following the first time period;

operating the first untwisting means during the second time period;

introducing the yarn ends of the first and second yarn portions to the yarn end splicer following the second time period.

* * * * *